US010687396B2

(12) United States Patent
Baek et al.

(10) Patent No.: US 10,687,396 B2
(45) Date of Patent: Jun. 16, 2020

(54) DEVICE AND METHOD FOR CONTROLLING BRIGHTNESS OF LIGHT SOURCE

(71) Applicant: Samsung Electronics Co., Ltd., Gyeonggi-do (KR)

(72) Inventors: Jong Jin Baek, Gyeonggi-do (KR); Hu Seung Lee, Seoul (KR)

(73) Assignee: Samsung Electronics Co., Ltd (KR)

( * ) Notice: Subject to any disclaimer, the term of this patent is extended or adjusted under 35 U.S.C. 154(b) by 979 days.

(21) Appl. No.: 15/235,723

(22) Filed: Aug. 12, 2016

(65) Prior Publication Data

US 2017/0048946 A1 Feb. 16, 2017

(30) Foreign Application Priority Data

Aug. 12, 2015 (KR) ..... 10-2015-0114120

(51) Int. Cl.
*H05B 45/10* (2020.01)
*G09G 3/34* (2006.01)

(52) U.S. Cl.
CPC ..... *H05B 45/10* (2020.01); *G09G 3/3406* (2013.01); *G09G 2320/0693* (2013.01); *G09G 2330/026* (2013.01)

(58) Field of Classification Search
None
See application file for complete search history.

(56) References Cited

U.S. PATENT DOCUMENTS 7,542,056 B2 * 6/2009 Oh ..... G09G 3/3611 345/102
8,384,746 B2 2/2013 Wan et al.
8,493,375 B2 * 7/2013 Bae ..... G09G 3/3208 345/211
9,218,763 B2 * 12/2015 Hwangbo ..... G09G 3/3208
9,489,166 B2 * 11/2016 Chang-Chian ..... G06F 3/1431
9,852,018 B2 * 12/2017 Kwon ..... G06F 11/0736
2003/0058202 A1 * 3/2003 Evanicky ..... G09G 3/006 345/82
2004/0061708 A1 * 4/2004 Oh ..... G09G 3/3611 345/690
2011/0025665 A1 * 2/2011 Bae ..... G09G 3/3208 345/211
2011/0115836 A1 5/2011 Wan et al.
2012/0133290 A1 * 5/2012 Hasegawa ..... H05B 33/0803 315/185 R
2013/0044089 A1 * 2/2013 Chang-Chian ..... G06F 3/1431 345/204
2013/0063050 A1 * 3/2013 Morikawa ..... G09G 3/001 315/316

(Continued)

FOREIGN PATENT DOCUMENTS

KR 1020040062168 7/2004
KR 1020110053200 5/2011

*Primary Examiner* — Patrick F Marinelli
(74) *Attorney, Agent, or Firm* — The Farrell Law Firm, P.C.

(57) ABSTRACT

Disclosed is an electronic device that includes a layer, a light source that irradiates light to the layer from a lower side of the layer, a regulator that supplies a voltage to the light source, and a processor electrically connected with the regulator. The processor determines an output voltage of the regulator based on information about the layer.

16 Claims, 9 Drawing Sheets

(56) References Cited

U.S. PATENT DOCUMENTS

| | | | | |
|---|---|---|---|---|
| 2013/0088480 | A1* | 4/2013 | Hong | G09G 3/3677 345/212 |
| 2013/0147780 | A1* | 6/2013 | Kita | G09G 5/001 345/211 |
| 2013/0155122 | A1* | 6/2013 | Choi | G09G 3/2096 345/690 |
| 2013/0278642 | A1* | 10/2013 | Dong | G09G 3/001 345/690 |
| 2014/0139132 | A1* | 5/2014 | Kwak | G09G 3/006 315/224 |
| 2014/0184480 | A1* | 7/2014 | Lee | G09G 3/3208 345/82 |
| 2014/0184654 | A1* | 7/2014 | Lee | G09G 3/3233 345/690 |
| 2014/0189444 | A1* | 7/2014 | Kwon | G06F 11/0736 714/48 |
| 2014/0253601 | A1* | 9/2014 | Ma | G09G 3/001 345/690 |
| 2015/0194088 | A1 | 7/2015 | Jung et al. | |
| 2017/0048946 | A1* | 2/2017 | Baek | H05B 33/0854 |

* cited by examiner

DEVICE AND METHOD FOR CONTROLLING BRIGHTNESS OF LIGHT SOURCE

PRIORITY

This application claims priority under 35 U.S.C. § 119(a) to a Korean Patent Application filed in the Korean Intellectual Property Office on Aug. 12, 2015 and assigned Serial Number 10-2015-0114120, the contents of which are incorporated herein by reference.

BACKGROUND

1. Field of the Disclosure

The present disclosure relates generally to an electronic device, and more particularly, to a technology for controlling brightness of a light source included in the electronic device.

2. Description of the Related Art

An electronic device, including a display, such as a smartphone or a tablet personal computer (PC) generally includes various function keys such as a menu key, and a back (or cancel) key in a black mask (BM) area on which a screen is not output. The electronic device includes a back light for the function keys to allow a user to distinguish locations of the function keys even in a low visibility environment.

When the electronic device includes the back light for the function keys, since the light transmittance of a layer through which light from the back light passes varies according to a color of the BM area, there is a need to adjust the brightness of the back light, which may be performed by regulating a driving voltage of the back light through pulse width modulation (PWM). As another example, the brightness of the back light may be adjusted by using different resistance values based on a color of the BM area.

When the brightness of the back light is adjusted through the PWM, radio frequency (RF) radiation or electromagnetic interference (EMI) is generated due to a square wave that is generated by PWM. Also, if the brightness of the back light is adjusted by using resistors, a bill of materials (BOM) that varies according to a color of the BM area of the electronic device is required. Accordingly, when electronic devices of various colors are manufactured, production management becomes more complex, and in turn, the manufacturing cost of the electronic device increases.

As such, there is a need in the art for an electronic device that controls back light brightness in an improved manner, without inordinately increasing cost.

SUMMARY

The present disclosure has been made to address at least the above-mentioned problems and/or disadvantages and to provide at least the advantages described below. Accordingly, an aspect of the present disclosure is to provide an electronic device that is capable of controlling brightness of a back light source without changing an internal configuration thereof or generating a noise signal, and a control method thereof.

In accordance with an aspect of the present disclosure, there is provided an electronic device including a layer, a light source that irradiates light to the layer from a lower side of the layer, a regulator that supplies a voltage to the light source, and a processor electrically connected with the regulator, wherein the processor determines an output voltage of the regulator based on information about the layer.

In accordance with another aspect of the present disclosure, there is provided a method of controlling brightness of a light source of an electronic device, including determining an output voltage of a regulator that supplies a voltage to the light source, based on information about a layer, supplying the output voltage to the light source, and irradiating light to the layer.

In accordance with another aspect of the present disclosure, there is provided an electronic device comprising a window including an area that covers at least a part of one surface of the electronic device and has at least one transmittance, a light source that irradiates light to the window from a lower side of an area of the window having a first transmittance, a regulator that supplies a voltage to the light source, and a processor electrically connected with the regulator, wherein the processor determines an output voltage of the regulator based on information about the window.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION OF EMBODIMENTS OF THE DISCLOSURE

Figure 1A:
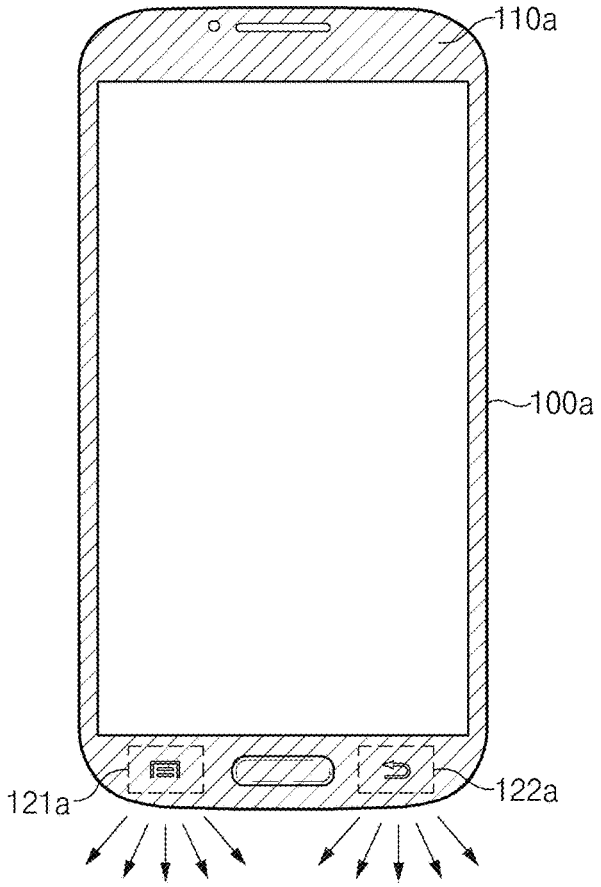
FIGS. 1A and 1B illustrate environments in which an electronic device according to embodiments of the present disclosure operates.

Embodiments of the present disclosure will be described with reference to accompanying drawings. Accordingly, those of ordinary skill in the art will recognize that modifications, equivalents, and/or alternatives on the embodiments described herein can be variously made without departing from the scope and spirit of the present disclosure. With regard to description of drawings, similar elements may be marked by similar reference numerals.

The expressions "have", "may have", "include" and "comprise", or "may include" and "may comprise" used herein indicate existence of corresponding features or elements such as numeric values, functions, operations, or components, but do not exclude presence of additional features.

The expressions "A or B", "at least one of A or/and B", or "one or more of A or/and B" used herein include any and all combinations of one or more of the associated listed items. For example, the expressions "A or B", "at least one of A and B", or "at least one of A or B" may refer to all of (1) where at least one A is included, (2) where at least one B is included, or (3) where both of at least one A and at least one B are included.

Expressions such as "first" and "second" used herein may refer to various elements of embodiments of the present disclosure, but do not limit the elements. For example, "a first user device" and "a second user device" indicate different user devices regardless of the order or priority, and a first element may be referred to as a second element, and similarly, a second element may be referred to as a first element.

It will be understood that when an element, such as a first element, is referred to as being "operatively or communicatively, coupled with/to" or "connected to" another element, such as a second element, the first element can be directly coupled with/to or connected to the second element or an intervening element, such as a third element, may be present. In contrast, when the first element is referred to as being "directly coupled with/to" or "directly connected to" the second element, it should be understood that there is no intervening third element present.

According to the situation, the expression "configured to" used herein may be used interchangeably with the expression "suitable for", "having the capacity to", "designed to", "adapted to", "made to", or "capable of". The term "configured to" does not only indicate "specifically designed to" in hardware. Instead, the expression "a device configured to" indicates that the device is "capable of" operating together with another device or other components. For example, a "processor configured to perform A, B, and C" may indicate an embedded processor for performing a corresponding operation or a generic-purpose processor, such as a central processing unit (CPU) or an application processor which performs corresponding operations by executing one or more software programs which are stored in a memory device.

Terms used in this specification are used to describe specified embodiments of the present disclosure and are not intended to limit the scope of the present disclosure. The terms of a singular form may include plural forms unless otherwise specified. Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in embodiments of the present disclosure. In some cases, even if terms are terms which are defined in the specification, they may not be interpreted to exclude embodiments of the present disclosure.

An electronic device according to embodiments of the present disclosure includes at least one of smartphones, tablet personal computers (PCs), mobile phones, video telephones, electronic book readers, desktop PCs, laptop PCs, netbook computers, workstations, servers, personal digital assistants (PDAs), portable multimedia players (PMPs), motion picture experts group (MPEG-1 or MPEG-2) Audio Layer 3 (MP3) players, mobile medical devices, cameras, or wearable devices including an accessory type, such as watches, rings, bracelets, anklets, necklaces, glasses, contact lens, or head-mounted-devices (HMDs), a fabric or garment-integrated type, such as electronic apparel, a body-attached type such as a skin pad or tattoos, or an implantable type such as an implantable circuit.

According to some embodiments, the electronic devices may be home appliances, such as at least one of televisions (TVs), digital versatile disc (DVD) players, audio devices, refrigerators, air conditioners, cleaners, ovens, microwave ovens, washing machines, air cleaners, set-top boxes, TV boxes such as Samsung HomeSync™, Apple TV™, or Google TV™, game consoles such as Xbox™ and PlayStation™, electronic dictionaries, electronic keys, camcorders, and electronic picture frames.

According to another embodiment, the electronic devices include at least one of portable medical measurement devices, such as a blood glucose monitoring device, a heartbeat measuring device, a blood pressure measuring device, or a body temperature measuring device, magnetic resonance angiography (MRA), magnetic resonance imaging (MRI), computed tomography (CT), scanners, and ultrasonic devices, navigation devices, global positioning system (GPS) receivers, event data recorders (EDRs), flight data recorders (FDRs), vehicle infotainment devices, electronic equipment for vessels, such as navigation systems and gyrocompasses, avionics, security devices, head units for vehicles, industrial or home robots, automated teller machines (ATMs), point of sales (POS) devices, or Internet of Things (IoT) devices, such as light bulbs, various sensors, electric or gas meters, sprinkler devices, fire alarms, thermostats, street lamps, toasters, exercise equipment, hot water tanks, heaters, or boilers.

According to some embodiments, the electronic devices include at least one of parts of furniture or buildings/structures, electronic boards, electronic signature receiving devices, projectors, or various measuring instruments such as water meters, electricity meters, gas meters, or wave meters. The electronic device may be one of the above-described devices or a combination thereof, and may be flexible, but is not limited to the above-described electronic devices and may include other electronic devices and new electronic devices according to the development of technology.

The term "user" used herein may refer to a person who uses an electronic device or may refer to an artificial intelligence electronic device that uses an electronic device.

Figure 1B:
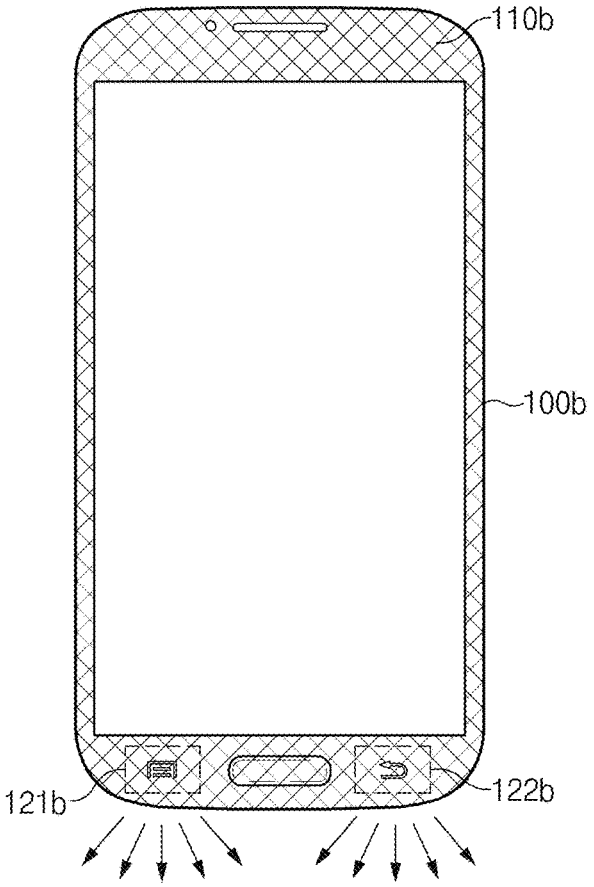

FIGS. 1A and 1B illustrate an environment in which an electronic device according to embodiments of the present disclosure operates.

Referring to FIG. 1A, an electronic device 100*a* includes a menu key 121*a* and a back key 122*a* in a black mask (BM) area 110*a*. Referring to FIG. 1B, an electronic device 100*b* includes a menu key 121*b* and a back key 122*b* in a BM area 110*b*.

The BM areas 110*a* and 110*b* may be formed of materials of different colors, and by using different processes.

In FIG. 1A, the menu key 121*a* may be disposed at a lower end portion of the electronic device 100*a*, and in FIG. 1B, the menu key 121*b* may be disposed at a lower end portion of the electronic device 100*b*. A light emitting diode (LED) may be disposed under each of the menu key 121*a* and the menu key 121*b* to allow a user to discriminate the menu key 121*a* and the menu key 121*b*. Each of the BM areas 110*a* and 110*b* may have a pattern through which light from the LED passes.

In FIG. 1A, the back key 122*a* may be disposed at the lower end portion of the electronic device 100*a*, and in FIG. 1B, the back key 122*b* may be disposed at the lower end portion of the electronic device 100*b*. An LED may be placed under the back key 122*a* and the back key 122*b* to allow the user to discriminate the back key 122*a* and the back key 122*b*. Each of the BM areas 110*a* and 110*b* may have a pattern through which light from the LED passes.

The light transmittance of the pattern through which the light passes may vary due to a difference between colors of the BM areas 110*a* and 110*b* and a difference between processes of forming the BM areas 110*a* and 110*b*. Accordingly, if light of the same brightness is irradiated from a lower side of the menu key 121*a* and the back key 122*a* in FIG. 1A, and a lower side of the menu key 121*b* and the back key 122*b* in FIG. 1B, luminance of light provided to a user of the electronic device 100*a* in FIG. 1A may be different from luminance of light provided to a user of the electronic device 100*b* in FIG. 1B.

For example, if the BM area 110*a* is of a white color and the BM area 110*b* is of a gold color, the light transmittance of the pattern included in the BM area 110*a* in FIG. 1A may be greater than that of the pattern included in the BM area 110*b* in FIG. 1B. The luminance of light passing through the pattern of the BM area 110*a* in FIG. 1A and the luminance of light passing through the pattern of the BM area 110*b* in FIG. 1B may be adjusted to be identical by decreasing a voltage to be supplied to the LED of the electronic device 100*a*. The luminance of light passing through the pattern of the BM area 110*a* and the luminance of light passing through the pattern of the BM area 110*b* may be adjusted to be identical by increasing a voltage to be supplied to the LED of the electronic device 100*a*.

Figure 2:
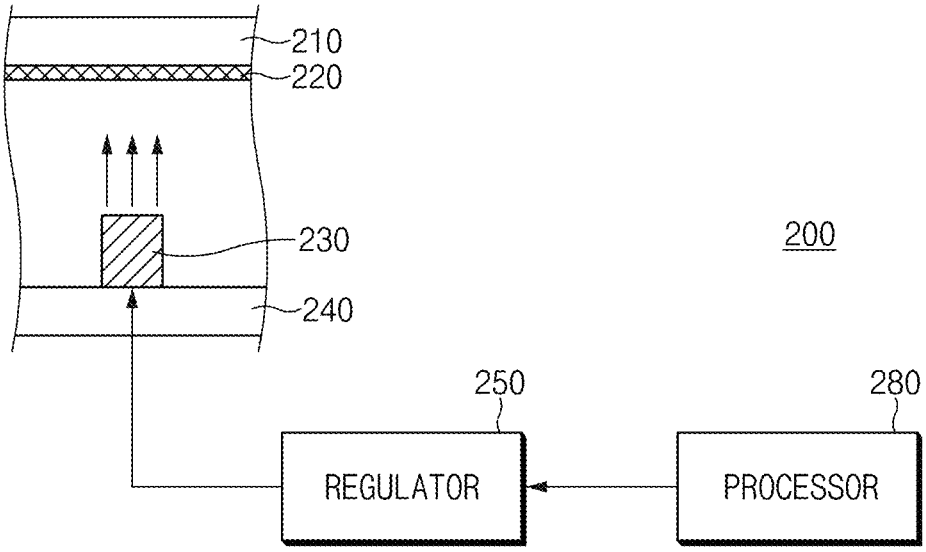
FIG. 2 illustrates a configuration of the electronic device according to an embodiment of the present disclosure.

FIG. 2 illustrates a configuration of the electronic device 200 according to an embodiment of the present disclosure.

Referring to FIG. 2, the electronic device 200 includes a window 210, a layer 220, a light source 230, a substrate 240, a regulator 250, and a processor 280.

The window 210 covers at least a part of one surface of the electronic device 200, may be disposed on a front surface of the electronic device 200, and may protect a display of the electronic device 200. The window 210 may be formed of a transparent material. The window 210 may be formed of a material such as a reinforced glass, plastic such as polyethylene terephthalate (PET), or aluminum oxide. The window 210 may have a display area being an area through which light output by the display passes and a BM area being the remaining area except for the display area. The BM area of the window 210 may have first transmittance, and the display area thereof may have second transmittance. That is, the window 210 may have a plurality of areas of which transmittances are different from each other. The display that provides an image processed by the processor 280 may be disposed under the display area of the window 210.

The layer 220 may be formed under the BM area of the window 210 to have various colors such as white, blue, gold, and silver, for example.

The layer 220 may be formed in various manners according to a color of the layer 220. For example, when the layer 220 is black or white, the layer 220 may be formed by repeatedly applying black ink or white ink on the BM area of the window 210. As another example, when the layer 220 is gold or silver, the layer 220 may be formed by repeatedly depositing a gold or silver color material on the BM area of the window 210. As another example, the layer 220 may be formed with a film that is separated from the window 210. Since the layer 220 is formed to have various colors and a process manner varies according to a color of the layer 220, the light transmittance of the layer 220 may vary according to a color of the layer 220.

According to an embodiment, the layer 220 includes a menu shape in an area corresponding to a function key such as a menu key or a back key, and includes the menu shape in an area for receiving an input associated with the function key to allow a location and a type of the function key to be discriminated. For example, the menu shape included in the layer 220 may be formed by applying light-shielding ink on the remaining area except for an area corresponding to the menu shape, or by applying ink through a mask corresponding to the menu shape. When light is irradiated from a lower side of the layer 220, light may be penetrated through the menu shape included in the layer 220. A user may distinguish a location and a type of the function key based on the light passing through the menu shape.

The light source 230 may be disposed under the BM area of the window 210 and may irradiate light to the window 210 under the layer 220. The light source 230 may be disposed under the layer 220 such that light is irradiated to the menu shape included in the layer 220.

The light source 230 may irradiate light of luminance that is proportional to the magnitude of a supply voltage. When a higher voltage is supplied to the light source 230, luminance of the light source 230 may increase. When a lower voltage is supplied to the light source 230, luminance of the light source 230 may decrease. The light source 230 may be a light-emitting diode (LED), for example.

The substrate 240 may support the light source 230. An embodiment is illustrated in FIG. 2 as the light source 230 is disposed on the substrate 240. However, the substrate 240 may further include a groove or opening for accommodating the light source 230. The light source 230 may be inserted into the groove or opening included in the substrate 240.

The regulator 250 may supply a voltage to the light source 230. The regulator 250 may supply a constant output voltage to the light source 230 when receiving an input voltage that varies according to a time. An output voltage of the regulator 250 may be variable. The regulator 250 may include two or more regulators.

The processor 280 may be electrically connected with the regulator 250 through a channel controlling driving voltage. The channel controlling driving voltage includes an inter-integrated circuit (I2C), a serial peripheral interface (SPI), or a general purpose input/output (GPIO).

The processor 280 determines the output voltage of the regulator 250 based on information about the layer 220. According to an embodiment, the processor 280 determines the output voltage of the regulator 250 based on previously stored information about the layer 220. The processor 280 obtains information about the layer 220 from any other element of the electronic device 200 and determines the output voltage of the regulator 250 based on the obtained information about the layer 220. For example, the processor 280 obtains product information of the layer 220, information associated with transmittance of the layer 220, or information associated with a color of the layer 220.

According to an embodiment, the processor 280 may adjust the output voltage of the regulator 250 based on the transmittance of the layer 220, thereby enabling luminance of light passing through layers of different colors to be constant. For example, the processor 280 may increase the output voltage of the regulator 250 if transmittance of the layer 220 is less than a designated value, and may decrease the output voltage of the regulator 250 if the transmittance of the layer 220 is greater than the designated value.

According to an embodiment, the processor 280 processes an image and outputs the processed image through the display. The image provided through the display may be output through the display area of the window 210.

Figure 3:
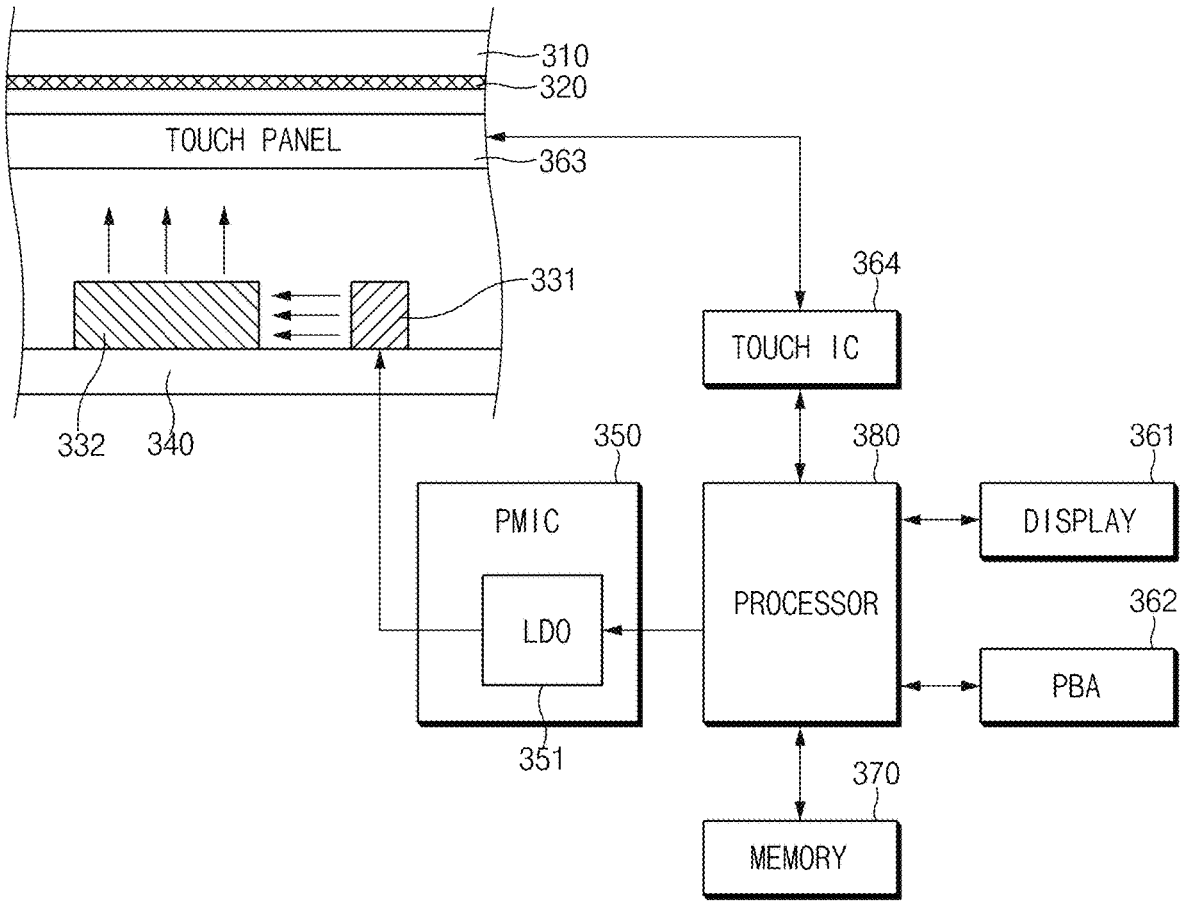
FIG. 3 illustrates a configuration of the electronic device according to another embodiment of the present disclosure.

FIG. 3 illustrates a configuration of the electronic device according to another embodiment of the present disclosure.

Referring to FIG. 3, an electronic device 300 includes a window 310, a layer 320, a light source 331, a light guide member 332, a substrate 340, a power management integrated circuit (PMIC) 350 including a low drop-out (LDO) regulator 351, a display 361, a printed board assembly (PBA) 362, a touch panel 363, a touch integrated circuit (IC) 364, a memory 370, and a processor 380. For descriptive convenience, a description of elements given with reference to FIG. 2 is omitted.

The touch panel 363 may be disposed under the window 310. The touch panel 363 may be disposed under the window 310 and the layer 320 or may be disposed between the window 310 and the layer 320. The touch panel 363 receives a touch input through the window 310. An input associated with a function key may be received through the touch panel 363.

The light source 331 may irradiate light toward the light guide member 332. The light source 331 may irradiate light while the touch panel 363 is being activated. The light source 331 may irradiate light during a designated time after the touch panel 363 is activated.

The light guide member 332 may be disposed under the layer 320. It may be possible to change a traveling direction of light irradiated from the light source 331. The light guide member 332 may be disposed such that light of which the traveling direction is changed is irradiated to the menu shape included in the layer 320.

The PMIC 350 may be an IC that controls electric power to be supplied to each element of the electronic device 300. The PMIC 350 controls electric power to be supplied to the light source 331, such as by the LDO regulator 351 included in the PMIC 350.

The LDO regulator 351 may variably adjust an output voltage thereof. The LDO regulator 351 may supply the output voltage to the light source 331. According to an embodiment, the LDO regulator 351 may be a variable LDO regulator that is capable of regulating the output voltage within a designated range. The LDO regulator 351 may include a plurality of LDO regulators that provide different output voltages.

The display 361 may store a multi-time programmable (MTP) identifier (ID). The MTP ID may be stored in a display driver IC (DDI) included in the display 361. The MTP ID includes a variety of information associated with the display 361, such as a line where the display 361 is manufactured. According to an embodiment, the MTP ID includes information about a color of the layer 320, such as 4-bit data indicating a color of the layer 320.

The PBA 362 stores its own hardware ID, and outputs a signal indicating the hardware ID. The hardware ID of the PBA 362 includes information about the layer 320, such as about a color of the layer 320.

The touch IC 364 receives a signal that the touch panel 363 generates based on a touch input. The touch IC 364 drives firmware for controlling the touch panel 363. The firmware stored in the touch IC 364 includes information about the layer 320, such as about a color of the layer 320.

Information about the layer 320 may be stored in the memory 370. According to an embodiment, the information about the layer 320 may be previously stored in the memory 370. According to an embodiment, the MTP ID obtained from the display 361, the hardware ID obtained from the PBA 362, or the information about the layer 320 obtained from the firmware of the touch IC 364 may be stored in the memory 370.

According to an embodiment, information in which information about the layer 320 and a voltage value are mapped to each other may be stored in the memory 370. For example, a table in which a color of the layer 320 and a magnitude of the output voltage are mapped to each other may be stored in the memory 370. For example, a black layer may be mapped to the output voltage of 2.8 V, and a gold layer may be mapped to the output voltage of 3.3 V in the table.

The processor 380 may be electrically connected with the PMIC 350, the LDO 351, the display 361, the PBA 362, the touch IC 364, and the memory 370, and obtains information about the layer 320 such as the MTP ID of the display 361, the hardware ID of the PBA 362, or the firmware information of the touch IC 364.

The processor 380 obtains the MTP ID stored in the display 361. For example, the processor 380 accesses the DDI of the display 361 to obtain the MTP ID.

The processor 380 obtains the hardware ID stored in the PBA 362. For example, the processor 380 receives a high or low signal from the PBA 362 through the GPIO and obtains the hardware ID of the PBA 362 based on the received signal.

The processor 380 obtains information about the layer 320 that is included in the firmware stored in the touch IC 364. For example, the processor 380 accesses the touch IC 364 to read information about the layer 320 included in the firmware.

According to an embodiment, the processor 380 determines the output voltage based on the MTP ID of the display 361, the hardware ID of the PBA 362, or the firmware information of the touch IC 364.

According to an embodiment, the processor 380 determines the output voltage based on information about the layer 320 previously stored in the memory 370. On the basis of information previously stored in the memory 370, the processor 380 determines the output voltage without obtaining information from any other element of the electronic device 300.

After storing the MTP ID of the display 361, the hardware ID of the PBA 362, or the firmware information of the touch IC 364 in the memory 370, the processor 380 determines the output voltage based on the information stored in the memory 370.

The processor 380 determines the output voltage based on information in which information about the layer 320 and a voltage value are mapped to each other. The information in which the information about the layer 320 and the voltage value are mapped to each other may be stored in the memory 370. For example, when a black layer is mapped to the output voltage of 2.8 V and a gold layer is mapped to the output voltage of 3.3 V, the processor 380 selects 2.8 V as the output voltage if the layer 320 is black and selects 3.3 V as the output voltage if the layer 320 is gold.

The processor 380 adjusts the output voltage of the variable LDO regulator based on information about the layer 320, and increases or decreases the output voltage of the variable LDO regulator based on a light transmittance of the layer 320. For example, if the layer 320 is of a color of which light transmittance is low, the processor 380 increases the output voltage of the variable LDO regulator. As another example, if the layer 320 is of a color of which light transmittance is high, the processor 380 decreases the output voltage of the variable LDO regulator.

According to an embodiment, the processor 380 selects one of a plurality LDO regulators based on information about the layer 320. For example, if the layer 320 is of a color of which light transmittance is low, the processor 380 may allow an LDO regulator of a higher output voltage to enable. For example, if the layer 320 is of a color of which light transmittance is high, the processor 380 allows an LDO regulator of a lower output voltage to be enabled.

Figure 4:
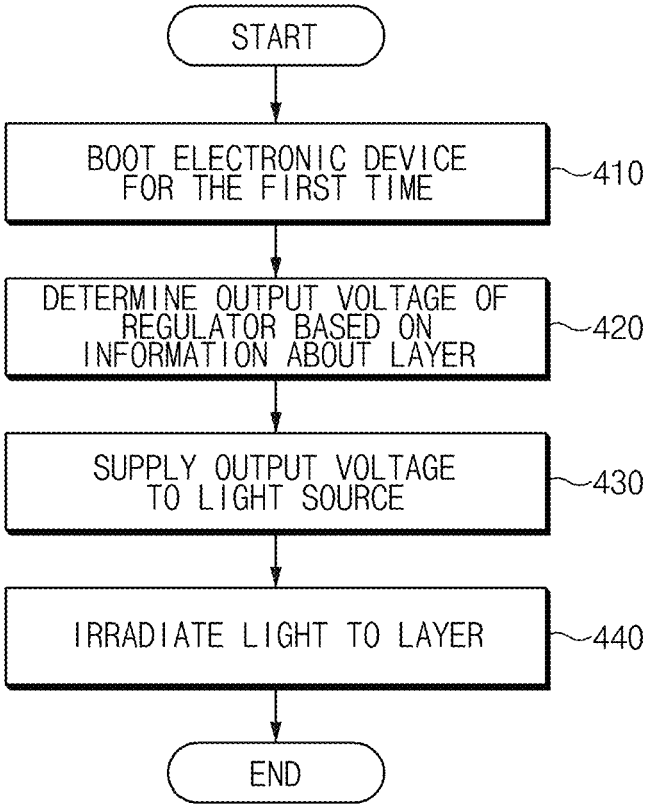
FIG. 4 illustrates a light source brightness control method of the electronic device, according to an embodiment of the present disclosure.

FIG. 4 illustrates a light source brightness control method of the electronic device, according to an embodiment of the present disclosure.

The flowchart illustrated in FIG. 4 includes operations that the electronic device 200 illustrated in FIG. 2 processes. The above description of the electronic device 200 given with reference to FIG. 2 may be applied to the method illustrated in FIG. 4.

Referring to FIG. 4, in operation 410, the electronic device 200 may be booted for the first time, such as after it is shipped from the factory. As another example, the electronic device 200 performs operations 420 to 440 when booted for the first time after it is reset.

In operation 420, the electronic device 200 determines an output voltage of the regulator 250 based on information about the layer 220, when booted for the first time, such as based on information about the layer 220 stored in a memory.

According to an embodiment, the electronic device 200 determines the output voltage of the regulator 250 based on a predefined rule. For example, when an output voltage for a blue layer is set to 3.3 V and an output voltage for a white layer is set to 2.8 V, the electronic device 200 may select 3.3 V as the output voltage if the layer 220 is of a blue color and select 2.8 V as the output voltage if the layer 220 is of a white color.

According to an embodiment, the electronic device 200 determines the output voltage of the regulator 250 based on light transmittance of the layer 220. For example, the electronic device 200 may select 3.5V as the output voltage if the light transmittance of the layer 220 is 0 to 1%, select 3.2V as the output voltage if the light transmittance of the layer 220 is 1 to 2%, and select 2.8 V as the output voltage if the light transmittance of the layer 220 is 2 to 3%.

In operation 430, the electronic device 200 supplies the determined output voltage to the light source 230. After regulating an input voltage to the output voltage determined in operation 420, the electronic device 200 may supply the output voltage to the light source 230. The electronic device 200 may supply the output voltage to the light source 230 if the touch panel of the electronic device 200 is activated.

In operation 440, the electronic device 200 irradiates light to the layer 220 by using the supplied output voltage. For example, the processor 200 irradiates light to the menu shape of the layer 220. Luminance of the output light may be proportional to the magnitude of the supplied output voltage. The irradiated light may be output through the menu shape of the layer 220.

Since the output voltage supplied to the light source 230 is determined according to a characteristic of the layer 220, light having constant luminance may be provided even though the light passes through layers of different colors.

Figure 5:
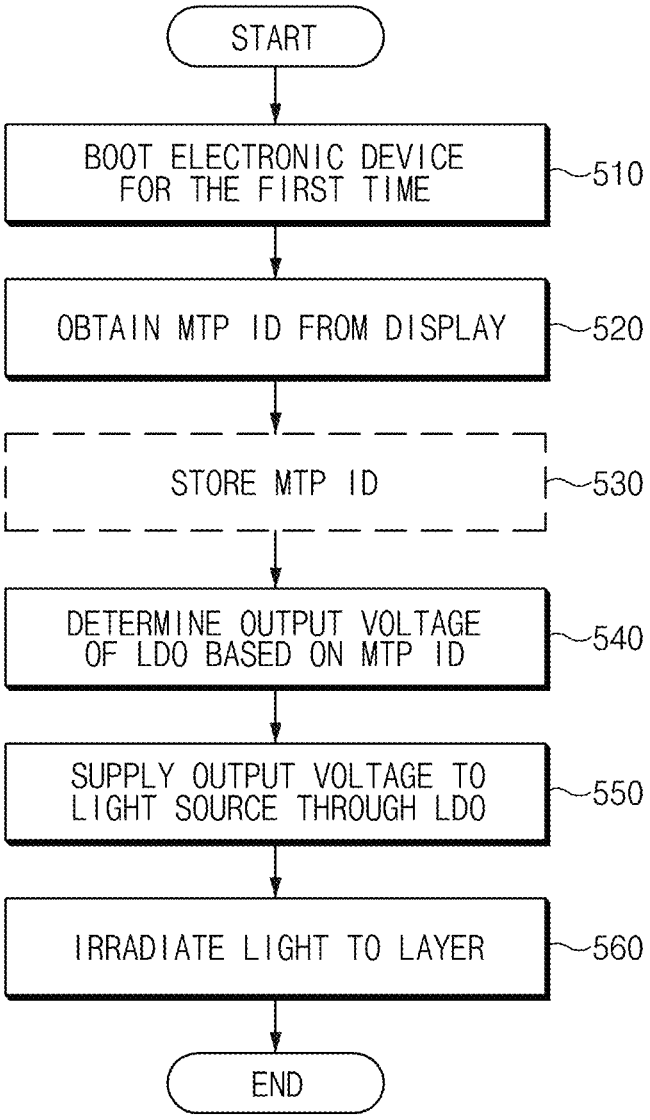
FIG. 5 illustrates a light source brightness control method of the electronic device, according to another embodiment of the present disclosure.

FIG. 5 illustrates a light source brightness control method of the electronic device, according to another embodiment of the present disclosure. For conciseness, a description of elements given with reference to FIG. 4 is omitted.

The flowchart illustrated in FIG. 5 includes operations that the electronic device 300 illustrated in FIG. 3 processes. The above description of the electronic device 300 given with reference to FIG. 3 may be applied to the method illustrated in FIG. 5.

Referring to FIG. 5, in operation 510, the electronic device 300 is booted for the first time.

In operation 520, the electronic device 300 obtains the MTP ID from the display 361 when booted for the first time. For example, the electronic device 300 accesses the DDI of the display 361 to obtain the MTP ID. The electronic device 300 obtains color information of the layer 320 included in the MTP ID.

In operation 530, the electronic device 300 stores the obtained MTP ID, such as in a volatile memory and uses the MTP ID stored in the volatile memory upon determining of the output voltage in operation 520. As another example, the electronic device 300 may store the MTP ID in a nonvolatile memory and use the MTP ID stored in the nonvolatile memory when rebooted operation 530 may be omitted according to implementation of the present disclosure.

In operation 540, the electronic device 300 determines the output voltage of the LDO regulator 351 based on the obtained MTP ID, such as based on color information of the layer 320 included in the MTP ID.

In operation 550, the electronic device 300 supplies the determined output voltage to the light source 331 through the LDO regulator 351. According to an embodiment, the electronic device 300 regulates the output voltage of the variable LDO regulator. For example, the electronic device 300 controls the variable LDO regulator such that the output voltage of the variable LDO regulator is converted to the voltage determined in operation 540. According to an embodiment, the electronic device 300 may select one LDO regulator, which provides the output voltage determined in operation 540, from among the plurality of LDO regulators and may set the selected LDO regulator to an enable state.

In operation 560, the electronic device 300 irradiates light to the layer 320 by using the supplied output voltage.

An embodiment is illustrated in FIG. 5 as the MTP ID is obtained from the display 361 and the output voltage is determined based on the obtained MTP ID. However, the electronic device 300 may obtain the hardware ID of the PBA 362 and determine the output voltage based on the obtained hardware ID. Alternatively, the electronic device 300 obtains firmware information stored in the touch IC 364 and determines the output voltage based on the obtained firmware information.

Figure 6:
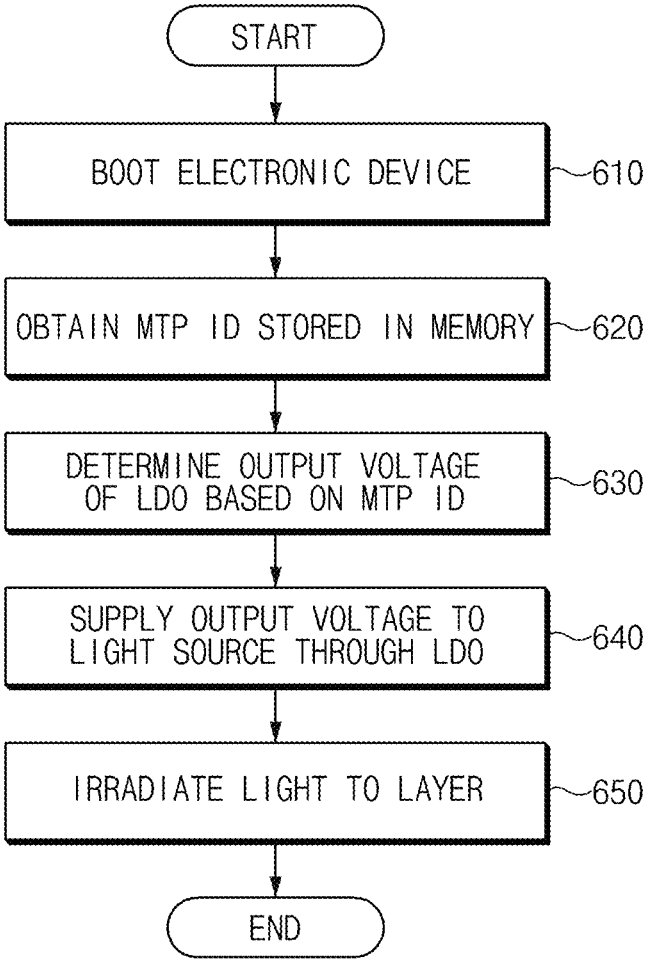
FIG. 6 illustrates a light source brightness control method of the electronic device, according to another embodiment of the present disclosure.

FIG. 6 illustrates a light source brightness control method of the electronic device, according to another embodiment of the present disclosure. For descriptive convenience, a description of elements given with reference to FIG. 4 is omitted.

The flowchart illustrated in FIG. 6 includes operations that the electronic device 300 illustrated in FIG. 3 processes. The above description of the electronic device 300 given with reference to FIG. 3 may be applied to the method illustrated in FIG. 6.

Referring to FIG. 6, in operation 610, the electronic device 300 is booted. For example, the electronic device 300 performs operation 620 to operation 650 when rebooted after the electronic device 300 is booted for the first time and then the MTP ID is stored in operation 530 of FIG. 5.

In operation 620, the electronic device 300 obtains the MTP ID stored in the memory 370 without accessing the display 361. That is, the electronic device 300 may use the MTP ID stored in the memory 370 at the first booting operation, without accessing the display 361 whenever the electronic device 300 is booted.

In operation 630, the electronic device 300 determines the output voltage of the LDO regulator 351 based on the obtained MTP ID.

In operation 640, the electronic device 300 supplies the determined output voltage to the light source 331 through the LDO regulator 351.

In operation 650, the electronic device 300 irradiates light to the layer 320 by using the supplied output voltage.

An embodiment is illustrated in FIG. 5 as the output voltage is determined based on the MTP ID. However, when the hardware ID of the PBA 362 or the firmware information of the touch IC 364 is stored in the memory 370, the electronic device 300 determines the output voltage based on the stored hardware ID of the PBA 362 or the stored firmware information of the touch IC 364.

Furthermore, color information of the layer 320 that is extracted from the MTP ID of the display 361, the hardware ID of the PBA 362, or the firmware information of the touch IC 364 may be stored in the memory 370. The electronic device 300 determines the output voltage of the LDO regulator 351 based on color information of the layer 320 stored in the memory 370.

Also, an output voltage value of the LDO regulator determined in operation 540 may be stored in the memory 370. The electronic device 300 may supply the output voltage value stored in the memory 370 to the light source 331 through the LDO regulator 351.

The following Table 1 illustrates a relation between a color of a layer and luminance of light passing through the layer. Data of Table 1 was obtained by irradiating light of the LED, to which voltages of 3.3 V and 2.8 V are respectively applied, to layers of "blue black", "gold", "black", and "white" colors and measuring luminance after the irradiated light passes through each layer.

TABLE 1

| Color of layer | Transmittance | Output voltage of LDO (V) | Illumination of LED (Lux) | Luminance after passing through layer (cd/mm$^2$) |
|---|---|---|---|---|
| Blue Black | 0.5~1% | 3.3 V | 1600 | 20~48 |
| Gold | 0.3~1.2% | 3.3 V | 1600 | 12~40 |
| Black | 1.5~2.5% | 3.3 V | 1600 | 60~100 |
| White | 2~3% | 3.3 V | 1600 | 80~120 |
| Black | 1.5~2.5% | 2.8 V | 700 | 26~44 |
| White | 2~3% | 2.8 V | 700 | 35~52 |

Referring to Table 1, since ink characteristics and layer forming techniques vary according to layer colors, the light transmittance of the layer may vary according to layer colors. Illuminance of the LED may be 1600 lux if a voltage of 3.3 V is applied to the LED and 700 lux if a voltage of 2.8 V is applied to the LED.

When the voltage of 3.3 V is applied to the LED, luminance of light passing through the layer of the "blue black" color may be 20 to 48 cd/mm$^2$. Luminance of light passing through the layer of the "gold" color may be 12 to 40 cd/mm$^2$. Luminance of light passing through the layer of the "black" color may be 60 to 100 cd/mm$^2$. Luminance of light passing through the layer of the "white" color may be 80 to 120 cd/mm$^2$.

That is, if the same voltage is applied to a layer of the "blue black" or "gold" color of which the transmittance is relatively small and a layer of the "black" or "white" color of which the transmittance is relatively great, a luminance difference between the layers after the light passes through the layers may be significantly great.

When the voltage of 2.8 V is applied to the LED, luminance of light passing through the layer of the "black" color may be 26 to 44 cd/m$^2$. Luminance of light passing through the layer of the "white" color may be 35 to 52 cd/mm$^2$.

That is, luminance of light passing through a layer may be adjusted to a constant level by applying a voltage of 3.3 V to the LED that irradiates light to a layer of the "blue black" or "gold" color and a voltage of 2.8 V to the LED that irradiates light to a layer of the "black" or "white" color.

The electronic device according to an embodiment of the present disclosure may adjust luminance of light passing through a layer to a constant level by regulating an output voltage of an LDO regulator in the light of a layer characteristic.

Figure 7:
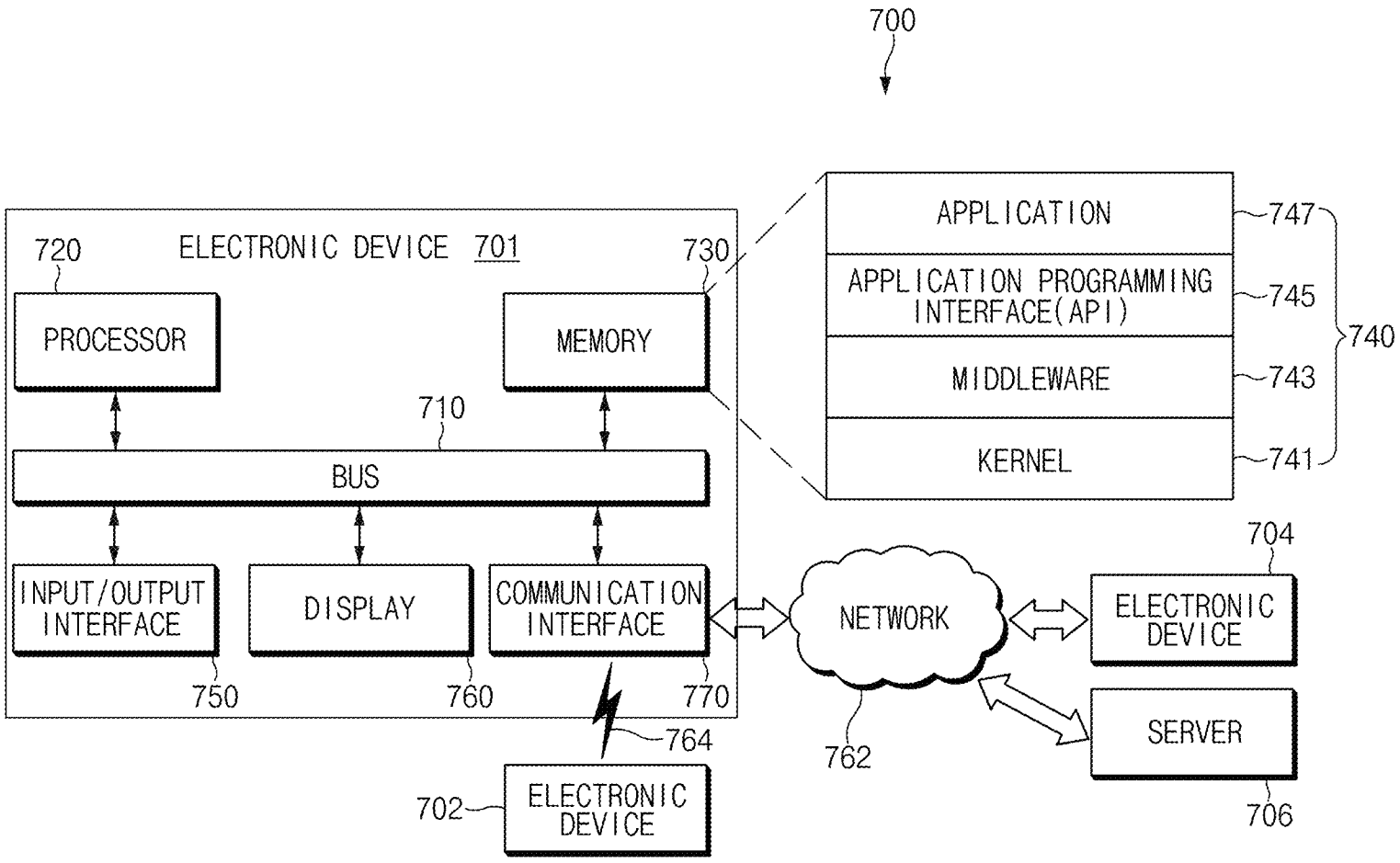
FIG. 7 is a block diagram of an electronic device in a network environment according to embodiments of the present disclosure.

FIG. 7 is a block diagram of an electronic device in a network environment 700 according to embodiments of the present disclosure.

Referring to FIG. 7, an electronic device 701, 702, or 704 and a server 706 may be connected with each other through a network 762 or a local area network 764. The electronic device 701 includes a bus 710, a processor 720, a memory 730, an input/output interface 750, a display 760, and a communication interface 770. The electronic device 701 may not include at least one of the above-described elements or may further include other element(s).

For example, the bus 710 may interconnect the above-described elements 710 to 770 and may be a circuit that conveys communications such as a control message and/or data among the above-described elements.

The processor 720 includes one or more of a central processing unit (CPU), an application processor (AP), or a communication processor (CP). For example, the processor 720 performs an arithmetic operation or data processing associated with control and/or communication of at least other elements of the electronic device 701.

The memory 730 includes a volatile and/or nonvolatile memory. The memory 730 may store instructions or data associated with at least one different element of the electronic device 701. According to an embodiment, the memory 730 may store software and/or a program 740. The program 740 includes a kernel 741, a middleware 743, an application programming interface (API) 745, and/or applications 747. At least some of the kernel 741, the middleware 743, and the API 745 may be referred to as an operating system (OS).

The kernel 741 controls or manages system resources such as the bus 710, the processor 720, and the memory 730 that are used to execute operations or functions of other programs. Furthermore, the kernel 741 may provide an interface that allows the middleware 743, the API 745, or the applications 747 to access discrete elements of the electronic device 701 so as to control or manage system resources.

The middleware 743 performs a mediation role such that the API 745 or the applications 747 communicate with the kernel 741 to exchange data.

Furthermore, the middleware 743 processes task requests received from the applications 747 according to a priority. For example, the middleware 743 assigns the priority, which enables use of a system resource of the electronic device 701, to at least one of the applications 747. For example, the middleware 743 processes the one or more task requests according to the priority assigned to the at least one, which enables scheduling or load balancing to be performed on the one or more task requests.

The API 745 may be an interface through which the applications 747 controls a function provided by the kernel 741 or the middleware 743, and includes at least one interface or function for a file control, window control, image processing, or character control.

The I/O interface 750 transmits an instruction or data, input from a user or another external device, to other element(s) of the electronic device 701. The input/output interface 750 outputs an instruction or data, received from other element(s) of the electronic device 701, to a user or another external device.

The display 760 includes a liquid crystal display (LCD), an LED display, an organic LED (OLED) display, a microelectromechanical systems (MEMS) display, or an electronic paper display. The display 760 displays a variety of content, such as a text, an image, a video, an icon, and a symbol, to a user. The display 760 includes a touch screen and receives a touch, gesture, proximity, or hovering input using an electronic pen or a part of a user's body.

The communication module 770 establishes communication between the electronic device 701 and an external device such as the first external electronic device 702, second external electronic device 704, or server 706. For example, the communication interface 770 may be connected to a network 762 through wireless communication or wired communication to communicate with the external device.

The wireless communication includes at least one of long-term evolution (LTE), LTE advanced (LTE-A), code division multiple access (CDMA), wideband CDMA (WCDMA), universal mobile telecommunications system (UMTS), wireless broadband (WiBro), or global system for mobile communications (GSM) as cellular communication protocol. The wireless communication includes the local area network 764 such as at least one of wireless fidelity (WiFi), Bluetooth, near field communication (NFC), magnetic stripe transmission (MST), or global navigation satellite system (GNSS).

The MST generates a transmission data-based pulse by using an electromagnetic signal, and a magnetic field signal may be generated by the pulse. The electronic device 701 transmits the magnetic field signal to a point of sales (POS) device, which recovers the data by detecting the magnetic field signal by using a MST reader and converting the detected magnetic field signal to an electrical signal.

The GNSS includes at least one of a global positioning system (GPS), a global navigation satellite system (Glonass), a Beidou Navigation Satellite System (Beidou), or the European global satellite-based navigation system (Galileo). Hereinafter "GPS" and "GNSS" may be used interchangeably. The wired communication includes at least one of a universal serial bus (USB), a high definition multimedia interface (HDMI), a recommended standard-232 (RS-232), or a plain old telephone service (POTS). The network 762 includes at least one of telecommunications networks such as a local area network (LAN) or wide area network (WAN), the Internet, or a telephone network.

Each of the first and second external electronic devices 702 and 704 may be a device of which the type is different from or the same as that of the electronic device 701. According to an embodiment, the server 706 includes a group of one or more servers. All or some of operations that the electronic device 701 will perform may be executed by another or plural electronic devices. When the electronic device 701 executes any function or service automatically or in response to a request, the electronic device 701 may not perform the function or the service internally, but, alternatively or additionally, it may request at least a part of a function associated with the electronic device 201 from another device, which executes the requested function or additional function and sends the execution result to the electronic device 701. The electronic device 701 may provide the requested function or service by using the received result or may additionally process the received result to provide the requested function or service. To this end a cloud computing, distributed computing, or client-server computing technology may be used.

Figure 8:
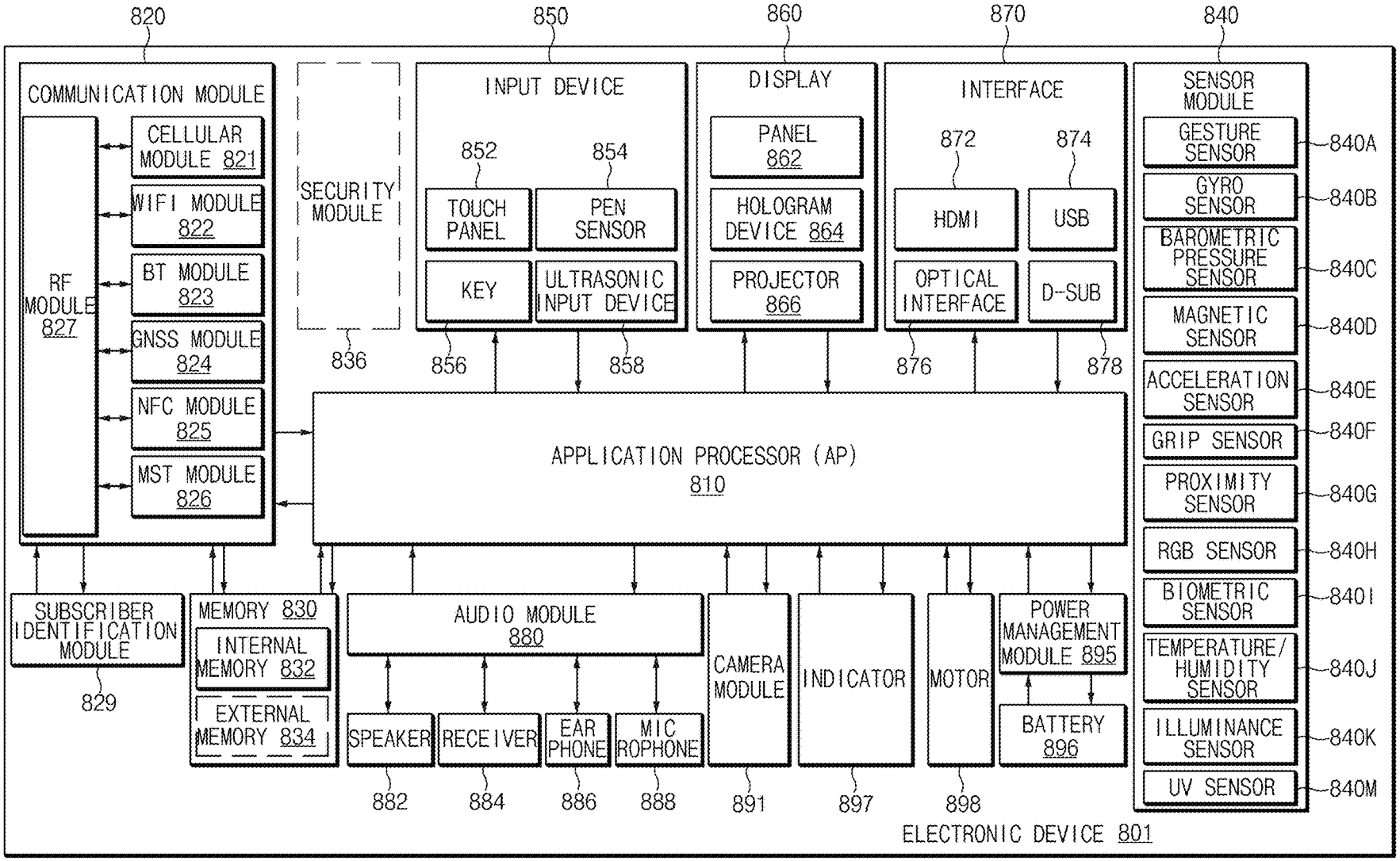
FIG. 8 is a block diagram of an electronic device according to embodiments of the present disclosure.

FIG. 8 is a block diagram illustrating an electronic device 801 according to embodiments of the present disclosure.

Referring to FIG. 8, the electronic device 801 includes all or a part of the electronic device 701 illustrated in FIG. 7. The electronic device 801 includes one or more processors such as an application processor 810, a communication module 820, a subscriber identification module (SIM) 829, a memory 830, a sensor module 840, an input device 850, a display module 860, an interface 870, an audio module 880, a camera module 891, a power management module 895, a battery 896, an indicator 897, and a motor 898.

The processor 810 drives an OS or an application to control a plurality of hardware or software components connected to the processor 810 and processes and computes a variety of data. For example, the processor 810 may be implemented with a system on chip (SoC). According to an embodiment, the processor 810 may further include a graphic processing unit (GPU) and/or an image signal processor. The processor 810 includes at least one of the elements illustrated in FIG. 8, loads and processes an instruction or data, which is received from at least one of other elements such as a nonvolatile memory, and stores a variety of data in a nonvolatile memory.

The communication module 820 may be configured the same as or similar to the communication interface 770 of FIG. 7, and includes a cellular module 821, a WiFi module 822, a Bluetooth (BT) module 823, a GNSS module 824 such as a GPS module, a Glonass module, a Beidou module, or a Galileo module, a near field communication (NFC) module 825, a MST module 826, and a radio frequency (RF) module 827.

The cellular module 821 may provide voice communication, video communication, a character service, or an Internet service over a communication network. The cellular module 821 performs discrimination and authentication of the electronic device 801 within a communication network by using the SIM card 829, performs at least some of functions that the processor 810 provides, and includes a communication processor (CP).

Each of the WiFi module 822, the BT module 823, the GNSS module 824, the NFC module 825, and the MST module 826 includes a processor for processing data exchanged through a corresponding module, for example. According to an embodiment, at least two elements of the cellular module 821, the WiFi module 822, the BT module 824, the GPS module 825, and the NFC module 826 may be included within one Integrated Circuit (IC) or an IC package.

The RF module 827 sends and receives an RF signal and includes a transceiver, a power amplifier module (PAM), a frequency filter, a low noise amplifier (LNA), and an antenna, for example. According to another embodiment, at least one of the cellular module 821, the WiFi module 822, the BT module 823, the GNSS module 824, and the NFC module 826 sends and receives an RF signal through a separate RF module.

The SIM 829 includes a card and/or embedded SIM and includes unique identify information such as an integrated circuit card identifier (ICCID), or subscriber information such as an integrated mobile subscriber identity (IMSI).

The memory 830 includes an internal memory 832 or an external memory 834. For example, the internal memory 832 includes at least one of a volatile memory, such as a dynamic random access memory (DRAM), a static RAM (SRAM), or a synchronous DRAM (SDRAM), a nonvolatile memory such as a one-time programmable read only memory (OTPROM), a programmable ROM (PROM), an erasable and programmable ROM (EPROM), an electrically erasable and programmable ROM (EEPROM), a mask ROM, a flash ROM, a NAND flash memory, or a NOR flash memory, a hard drive, or a solid state drive (SSD).

The external memory 834 includes a flash drive such as compact flash (CF), secure digital (SD), micro secure digital (Micro-SD), mini secure digital (Mini-SD), extreme digital (xD), a multimedia card (MMC), or a memory stick. The external memory 834 may be operatively and/or physically connected to the electronic device 801 through various interfaces.

The security module 836 includes a storage space of which a security level is higher than that of the memory 830 may be a circuit that guarantees a safe data storage and secured execution environment. The security module 836 may be implemented with a separate circuit and includes a separate processor. For example, the security module 836 may exist in a smart chip or secure digital (SD) card, which is attachable and detachable, or may include an embedded secure element (eSE) embedded in a fixed chip of the electronic device 801. Furthermore, the security module 836 may be driven on an OS that is different from that of the electronic device 801. For example, the security module 836 may operate based on java card open platform (JCOP) OS.

The sensor module 840 may measure a physical quantity or may detect an operation state of the electronic device 801, and convert the measured or detected information to an electric signal. The sensor module 840 includes at least one of a gesture sensor 840A, a gyro sensor 840B, a barometric pressure sensor 840C, a magnetic sensor 840D, an acceleration sensor 840E, a grip sensor 840F, a proximity sensor 840G, a color sensor 840H such as a red, green, blue (RGB) sensor, a biometric sensor 840I, a temperature/humidity sensor 840J, an illuminance sensor 840K, or an UV sensor 840M. Additionally or alternatively, the sensor module 840 may further include an E-nose sensor, an electromyography sensor (EMG) sensor, an electroencephalogram (EEG) sensor, an electrocardiogram (ECG) sensor, a photoplethysmographic (PPG) sensor, an infrared (IR) sensor, an iris sensor, and/or a fingerprint sensor. The sensor module 840 may further include a control circuit for controlling at least one or more sensors included therein. The electronic device 801 may further include a processor which is a part of the processor 810 or independent of the processor 810 and is configured to control the sensor module 840. The processor controls the sensor module 840 while the processor 810 remains in a sleep state.

The input device 850 includes a touch panel 852, a (digital) pen sensor 854, a key 856, and an ultrasonic input unit 858. The touch panel 852 may use at least one of capacitive, resistive, infrared and ultrasonic detecting methods. The touch panel 852 may further include a control circuit. The touch panel 852 may further include a tactile layer to provide a tactile reaction to a user.

The (digital) pen sensor 854 may be a part of a touch panel or includes an additional sheet for recognition. The key 856 includes a physical button, an optical key, or a keypad. The ultrasonic input device 858 detects or senses an ultrasonic signal, which is generated from an input device, through a microphone 888 and verifies data corresponding to the detected ultrasonic signal.

The display module 860 includes a panel 862, a hologram device 864, or a projector 866. The panel 862 may be configured to be the same as or similar to the display 760 of FIG. 7. The panel 862 may be implemented to be flexible, transparent, or wearable. The panel 862 and the touch panel 852 may be integrated into a single module. The hologram device 864 displays a stereoscopic image in a space by using a light interference phenomenon. The projector 866 may project light onto a screen so as to display an image. The screen may be arranged in the interior or the outside of the electronic device 801. According to an embodiment, the display module 860 may further include a control circuit for controlling the panel 862, the hologram device 864, or the projector 866.

The interface 870 includes a high-definition multimedia interface (HDMI) 872, a universal serial bus (USB) 874, an optical interface 876, or a D-subminiature (D-sub) 878. The interface 870 may be included in the communication interface 770 illustrated in FIG. 7. Additionally or alternatively, the interface 870 may include a mobile high definition link (MHL) interface, an SD card/multi-media card (MMC) interface, or an infrared data association (IrDA) standard interface.

The audio module 880 may convert sound and an electric signal in dual directions. At least some of the elements of the audio module 880 may be included in the input/output interface 750 illustrated in FIG. 7. The audio module 880 processes sound information that is input or output through a speaker 882, a receiver 884, an earphone 886, or the microphone 888, for example.

The camera module 891 for shooting a still image or a video includes at least one image sensor such as a front sensor or a rear sensor, a lens, an image signal processor (ISP), or a flash such as an LED or a xenon lamp.

The power management module 895 manages electric power of the electronic device 801. According to an embodiment, a power management integrated circuit (PMIC), a charger IC, or a battery gauge may be included in the power management module 895. The PMIC may have a wired charging method and/or a wireless charging method. The wireless charging method includes a magnetic resonance method, a magnetic induction method or an electromagnetic method and may further include an additional circuit such as a coil loop, a resonant circuit, or a rectifier. The battery gauge may measure a remaining capacity of the battery 896 and a voltage, current or temperature thereof while the battery is charged. The battery 896 includes a rechargeable battery and/or a solar battery.

The indicator 897 displays a specific state of the electronic device 801 or a part thereof, such as a booting state, a message state, or a charging state. The motor 898 converts an electrical signal into mechanical vibration and generates vibration and haptic effects, for example. Even though not illustrated, a processing device for supporting a mobile TV may be included in the electronic device 801. The processing device for supporting a mobile TV processes media data according to the standards of, for example, digital multimedia broadcasting (DMB), digital video broadcasting (DVB), or Mediaflo™.

Each of the above-mentioned elements of the electronic device according to embodiments of the present disclosure may be configured with one or more components, and the names of the elements may vary according to the type of the electronic device. The electronic device according to embodiments includes at least one of the above-mentioned elements, and the electronic device may not include some thereof or may further include other elements. Some of the elements of the electronic device according to embodiments may be combined with each other so as to form one entity, so that the functions of the elements may be performed in the same manner as before the combination.

Figure 9:
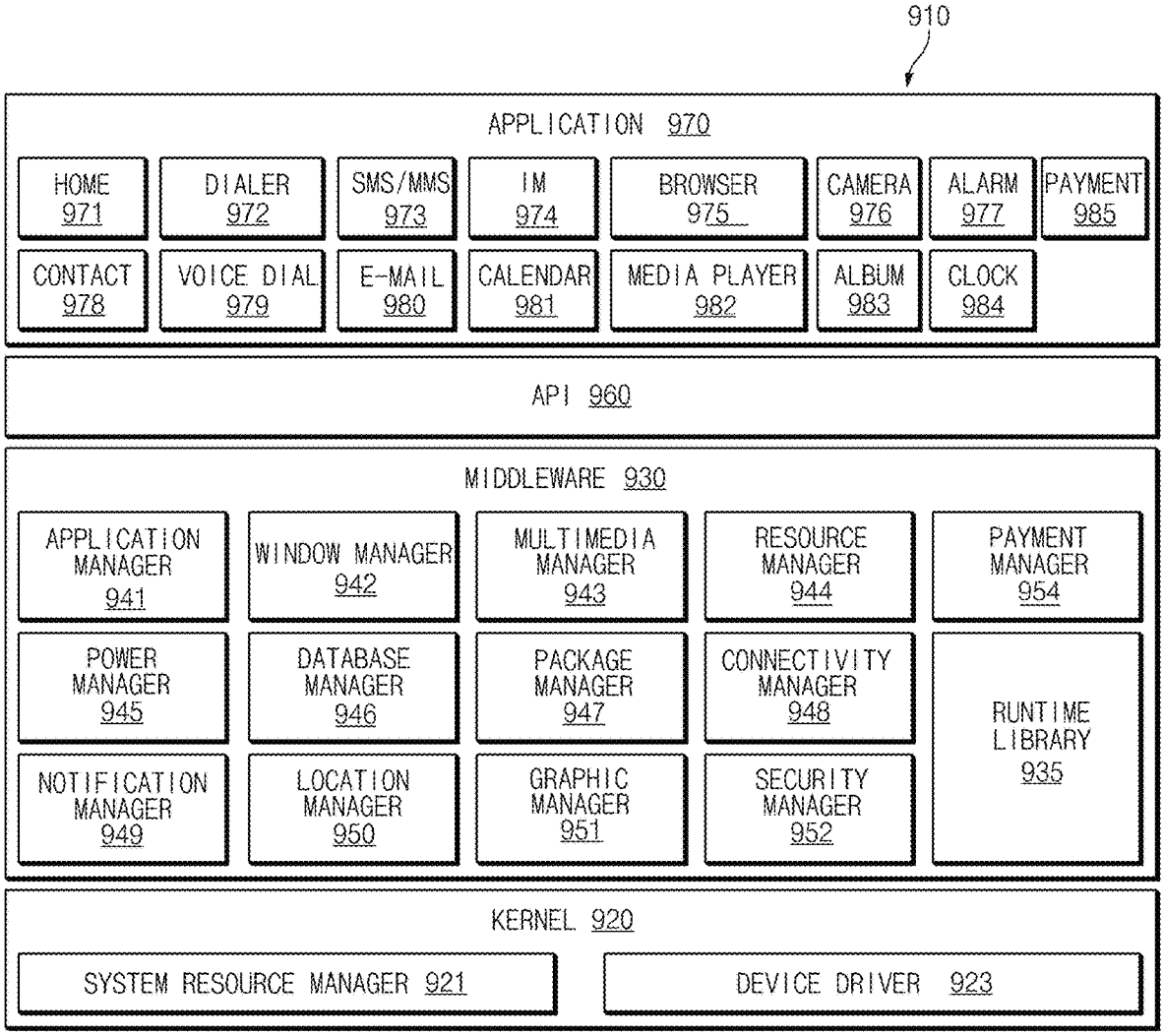
FIG. 9 is a block diagram of a program module according to embodiments.

FIG. 9 illustrates a block diagram of a program module according to embodiments of the present disclosure.

According to an embodiment, a program module 910 includes an OS to control resources associated with an electronic device, and/or various applications driven on the OS. The OS may be android, iOS, windows, symbian, tizen, or bada.

The program module 910 includes a kernel 920, a middleware 930, an API 960, and/or an applications 970. At least a part of the program module 910 may be preloaded on an electronic device or may be downloadable from an external electronic device.

The kernel 920 includes a system resource manager 921 and a device driver 923. The system resource manager 921 performs control, allocation, or retrieval of system resources and includes a process managing unit, a memory managing unit, or a file system managing unit. The device driver 923 includes a display driver, a camera driver, a Bluetooth driver, a common memory driver, an USB driver, a keypad driver, a WiFi driver, an audio driver, or an inter-process communication (IPC) driver.

The middleware 930 may provide a function which the applications 970 need in common, or may provide various functions to the applications 970 through the API 960 to allow the applications 970 to efficiently use limited system resources of the electronic device. According to an embodiment, the middleware 930 includes at least one of a runtime library 935, an application manager 941, a window manager 942, a multimedia manager 943, a resource manager 944, a power manager 945, a database manager 946, a package manager 947, a connectivity manager 948, a notification manager 949, a location manager 950, a graphic manager 951, a security manager 952, and a payment manager 954.

The runtime library 935 includes a library module that is used by a compiler to add a new function through a programming language while the applications 970 is being executed. The runtime library 935 performs input/output management, memory management, or capacities about arithmetic functions.

The application manager 941 manages a life cycle of at least one of the applications 970. The window manager 942 manages a GUI resource which is used in a screen. The multimedia manager 943 identifies a format necessary for playing various media files and performs encoding or decoding of media files by using a codec suitable for the format. The resource manager 944 manages resources such as a storage space, memory, or source code of at least one application of the applications 970.

The power manager 945 may operate with a basic input/output system (BIOS) to manage a battery or power, and may provide power information for an operation of an electronic device. The database manager 946 may generate, search for, or modify database which is to be used in at least one application of the applications 970. The package manager 947 may install or update an application that is distributed in the form of package file.

The connectivity manager 948 manages wireless connection such as WiFi or Bluetooth. The notification manager 949 displays or notifies an event such as arrival message, promise, or proximity notification in a mode that does not disturb a user. The location manager 950 manages location information of an electronic device. The graphic manager 951 manages a graphic effect that is provided to a user or manage a user interface relevant thereto. The security manager 952 may provide a general security function necessary for system security or user authentication. According to an embodiment, when an electronic device includes a telephony function, the middleware 930 may further include a telephony manager for managing a voice or video call function of the electronic device.

The middleware 930 includes a middleware module that combines diverse functions of the above-described components. The middleware 930 may provide a module specialized to each OS type to provide differentiated functions. Additionally, the middleware 930 may remove a part of the preexisting components, dynamically, or may add a new component thereto.

The API 960 may be a set of programming functions and may be provided with a configuration which is variable depending on an OS. For example, when an OS is android or iOS, it may be permissible to provide one API set per platform. When an OS is tizen, it may be permissible to provide two or more API sets per platform.

The applications 970 include one or more applications capable of providing functions for a home 971, a dialer 972, an SMS/MMS 973, an instant message (IM) 974, a browser 975, a camera 976, an alarm 977, a contact 978, a voice dial 979, an e-mail 980, a calendar 981, a media player 982, an album 983, and clock 984, and a payment 985, or for offering health care information, such as measuring an exercise quantity or blood sugar, or environment information, such as atmospheric pressure, humidity, or temperature.

According to an embodiment, the applications 970 include an information exchanging application to support information exchange between the electronic device, the electronic device and an external electronic device. The information exchanging application includes a notification relay application for transmitting specific information to the external electronic device, or a device management application for managing the external electronic device.

For example, the information exchanging application includes a function of transmitting notification information, which arise from other applications such as for SMS/MMS, e-mail, health care, or environmental information, to an external electronic device. Additionally, the information exchanging application receives notification information from an external electronic device and provide the notification information to a user.

The device management application installs, deletes, or updates at least one function such as turn-on/turn-off all or part of an external electronic device itself or adjustment of brightness of a display of the external electronic device that communicates with the electronic device, an application running in the external electronic device, or a call or message service provided from the external electronic device.

According to an embodiment, the applications 970 include a health care application which is assigned in accordance with an attribute of a mobile medical device of an external electronic device. The applications 970 include an application which is received from an external electronic device. The applications 970 include a preloaded application or a third party application which is downloadable from a server. The component titles of the program module 910 according to the embodiment of the present disclosure may be modifiable depending on types of OSs.

According to embodiments, at least a part of the program module 910 may be implemented by software, firmware, hardware, or a combination of two or more thereof. At least a part of the program module 910 may be implemented by a processor. At least a part of the program module 910 includes modules, programs, routines, sets of instructions, or processes for performing one or more functions.

The term "module" used herein may represent a unit including one or more combinations of hardware, software and firmware. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" includes at least one of an application-specific IC (ASIC) chip, a field-programmable gate array (FPGA), and a programmable-logic device for performing some operations, which are known or will be developed.

At least a part of an apparatus or a method according to embodiments may be implemented by instructions stored in a computer-readable storage media in the form of a program module. The instructions, when executed by one or more processors, may cause the one or more processors to perform a function corresponding to the instruction. The computer-readable storage media may be the memory 730.

A computer-readable recording medium includes a hard disk, a magnetic media, a floppy disk, magnetic media, an optical media such as a compact disc read only memory (CD-ROM) and a digital versatile disc (DVD), a magneto-optical media such as a floptical disk, and hardware devices such as a read only memory (ROM), a random access memory (RAM), or a flash memory. The program instructions may include not only a mechanical code such as things generated by a compiler but also a high-level language code executable on a computer using an interpreter. The above hardware unit may be configured to operate via one or more software modules for performing an operation according to embodiments, and vice versa.

A module or a program module according to embodiments may include at least one of the above elements, or a part of the above elements may be omitted, or additional other elements may be further included. Operations performed by a module, a program module, or other elements according to embodiments may be executed sequentially, in parallel, repeatedly, or in a heuristic method. Furthermore, some of operations may be executed in different sequences, may be omitted, or may further include other operations.

According to embodiments of the present disclosure, brightness of light passing through a layer may be adjusted to a target level by controlling the brightness of the light based on a characteristic of the layer through which the light passes.

Since brightness of a light source is controlled by using information stored in an electronic device, it may be possible to simplify a manufacturing execution system and reduce a manufacturing cost.

Since the brightness of the light source is controlled by adjusting an output voltage of a regulator, electromagnetic interference (EMI) may be prevented from being generated.

While the present disclosure has been shown and described with reference to embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a layer;

a light source that irradiates light to the layer window from a lower side of the layer;

a regulator that supplies a voltage to the light source; and a processor electrically connected with the regulator, wherein the processor determines an output voltage of the regulator based on information about the layer, wherein the processor further obtains information associated with a transmittance of the layer and determines the output voltage of the regulator based on the information associated with the transmittance of the layer.

2. The electronic device of claim 1, wherein the processor further obtains information associated with a color of the layer and determines the output voltage of the regulator based on the information associated with the color of the layer.

3. The electronic device of claim 1, further comprising: a display, wherein the processor further obtains a multi-time programmable (MTP) identifier (ID) stored in the display and determines the output voltage of the regulator based on the MTP ID.

4. The electronic device of claim 1, further comprising: a printed board assembly (PBA), wherein the processor further obtains a hardware identifier (ID) stored in the PBA and determines the output voltage of the regulator based on the hardware ID.

5. The electronic device of claim 1, further comprising: a touch integrated circuit (IC), wherein the processor further obtains the information about the layer included in firmware of the touch IC.

6. The electronic device of claim 1, further comprising: a memory, wherein the processor further determines the output voltage of the regulator based on the information about the layer stored in the memory.

7. The electronic device of claim 1, further comprising: a memory, wherein the processor further determines the output voltage based on information in which the information about the layer and a voltage value are mapped to each other.

8. The electronic device of claim 1, wherein the processor further increases the output voltage if a transmittance of the layer is less than a value.

9. The electronic device of claim 1, wherein the processor further decreases the output voltage if a transmittance of the layer is greater than a value.

10. The electronic device of claim 1, wherein the regulator comprises a variable low drop-out (LDO) regulator, and wherein the processor further determines an output voltage of the variable LDO regulator based on the information about the layer.

11. The electronic device of claim 1, wherein the regulator comprises a plurality of LDO regulators, and wherein the processor further selects one of the plurality of LDO regulators based on the information about the layer.

12. A method of controlling brightness of a light source of an electronic device, the method comprising:

determining an output voltage of a regulator that supplies a voltage to the light source, based on information about a layer;

supplying the output voltage to the light source;

irradiating light to the layer; and obtaining the information about the layer included in firmware of a touch integrated circuit (IC).

13. The method of claim 12, wherein obtaining the information comprises: obtaining a multi-time programmable (MTP) identifier (ID) stored in a display, wherein the output voltage of the regulator is determined based on the MTP ID.

14. The method of claim 12, wherein obtaining the information comprises:

obtaining a hardware identifier (ID) stored in a printed board assembly (PBA), wherein the output voltage of the regulator is determined based on the hardware ID.

15. An electronic device comprising:

a window including an area that covers at least a part of one surface of the electronic device and has at least one transmittance;

a light source that irradiates light to the window from a lower side of an area of the window having a first transmittance;

a regulator that supplies a voltage to the light source; and a processor electrically connected with the regulator, wherein the processor determines an output voltage of the regulator based on information about the window.

16. The electronic device of claim 15, further comprising:

a display that provides an image processed by the processor at a lower side of an area of the window having a second transmittance.

* * * * *